US011560749B2

(12) United States Patent
Neander et al.

(10) Patent No.: US 11,560,749 B2
(45) Date of Patent: Jan. 24, 2023

(54) INSULATING GLAZING WITH DOUBLE SPACER

(71) Applicant: SAINT-GOBAIN GLASS FRANCE, Courbevoie (FR)

(72) Inventors: Marcus Neander, Eschweiler (DE); Bianca Bergs, Gangelt (DE)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 0 days.

(21) Appl. No.: 17/280,732

(22) PCT Filed: Oct. 22, 2019

(86) PCT No.: PCT/EP2019/078621
§ 371 (c)(1),
(2) Date: Mar. 26, 2021

(87) PCT Pub. No.: WO2020/094380
PCT Pub. Date: May 14, 2020

(65) Prior Publication Data

US 2021/0381303 A1 Dec. 9, 2021

(30) Foreign Application Priority Data

Nov. 8, 2018 (EP) ..... 18205063

(51) Int. Cl.
*E06B 3/663* (2006.01)
*E06B 3/67* (2006.01)
(Continued)

(52) U.S. Cl.
CPC ..... *E06B 3/66319* (2013.01); *E06B 3/66352* (2013.01); *E06B 3/66361* (2013.01);
(Continued)

(58) Field of Classification Search
CPC ..... E06B 6/66; E06B 3/6612; E06B 3/663; E06B 3/66314; E06B 3/66309;
(Continued)

(56) References Cited

U.S. PATENT DOCUMENTS 6,737,129 B2 * 5/2004 Bayer ..... E06B 3/66314 428/34
2002/0192473 A1 12/2002 Gentilhomme et al.
(Continued)

FOREIGN PATENT DOCUMENTS

CH 687937 A5 3/1997
CN 103261960 A 8/2013
(Continued)

OTHER PUBLICATIONS

Machine Translation of JP H07-279544 (Year: 1995).*
(Continued)

*Primary Examiner* — Zachary M Davis
(74) *Attorney, Agent, or Firm* — Pillsbury Winthrop Shaw Pittman LLP

(57) ABSTRACT

An insulating glazing includes a first pane, a second pane, an inner spacer frame arranged between the panes, which, together with the panes, delimits an inner interpane space, a surrounding outer spacer frame arranged between the panes, which is arranged on the outward facing side of the inner spacer frame, wherein the inner spacer frame consists substantially of a first hollow profile spacer and the outer spacer frame consists substantially of a second hollow profile spacer, the inner spacer frame and the outer spacer frame are in each case connected together to the first pane and the second pane via a primary sealant, an outer interpane space between the outer side of the outer spacer frame and the first pane and the second pane is filled with a secondary sealant.

10 Claims, 3 Drawing Sheets

Figure 1:
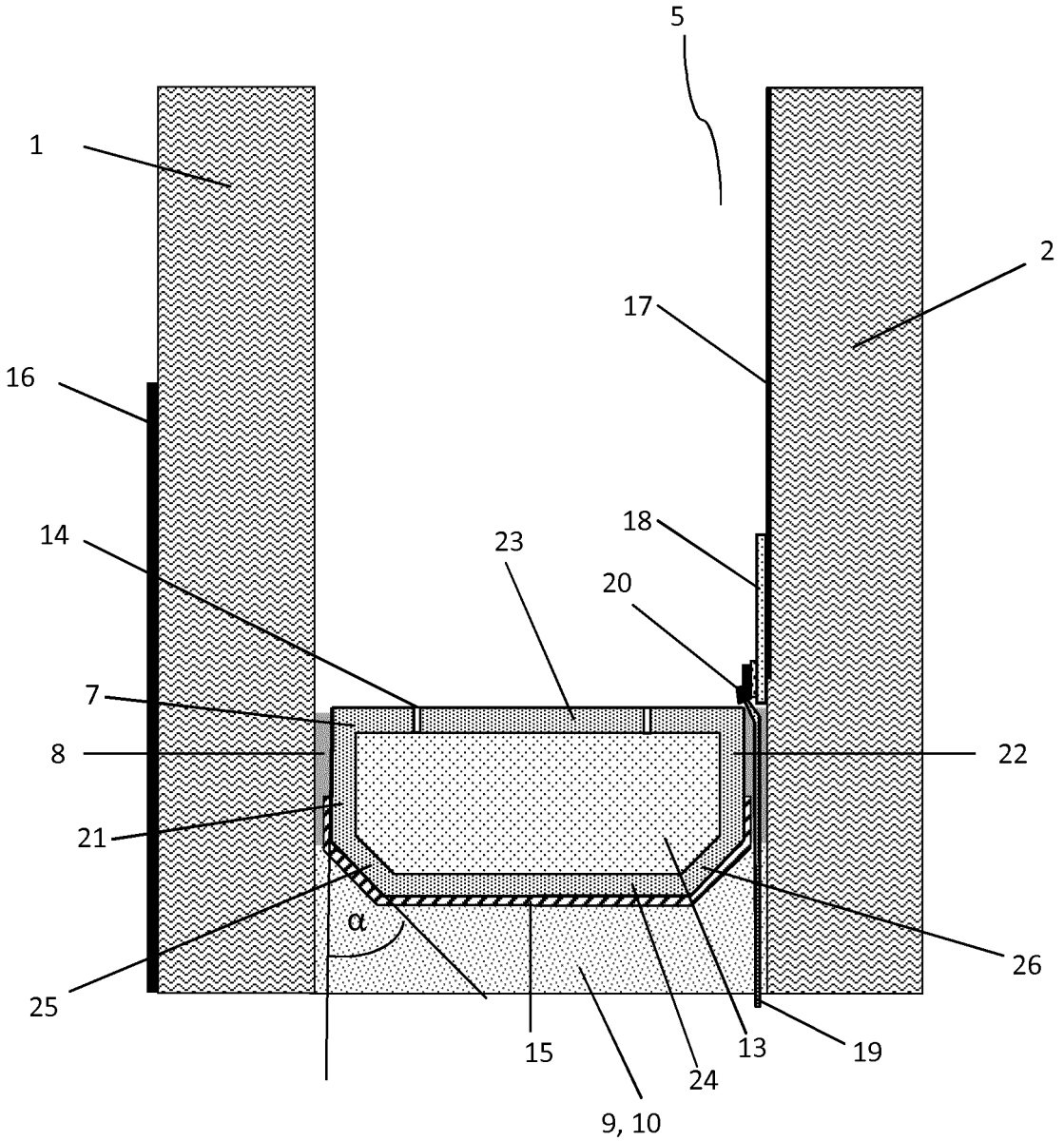

(51) Int. Cl.
*E06B 3/673* (2006.01)
*E06B 9/24* (2006.01)

(52) U.S. Cl.
CPC ..... *E06B 3/6722* (2013.01); *E06B 3/6733* (2013.01); *E06B 9/24* (2013.01); *E06B 2009/2464* (2013.01)

(58) Field of Classification Search
CPC . E06B 3/66319; E06B 3/66328; Y02B 80/22; Y02A 30/249; G02F 1/133; G02F 1/161; G02F 1/163; G02F 1/166
See application file for complete search history.

(56) References Cited

U.S. PATENT DOCUMENTS

| | | | | |
|---|---|---|---|---|
| 2004/0227462 | A1 | 11/2004 | Utsumi et al. | |
| 2007/0077376 | A1* | 4/2007 | Mamiya ..... | E06B 3/66361 428/34 |
| 2012/0026573 | A1 | 2/2012 | Collins et al. | |
| 2012/0147449 | A1 | 6/2012 | Bhatnagar et al. | |
| 2014/0247475 | A1 | 9/2014 | Parker et al. | |
| 2014/0311065 | A1* | 10/2014 | Schreiber ..... | E06B 3/66319 52/204.593 |
| 2015/0292258 | A1* | 10/2015 | Pellini ..... | B32B 27/08 428/34 |

FOREIGN PATENT DOCUMENTS

| | | | | | |
|---|---|---|---|---|---|
| CN | 108366681 | A | | 8/2018 | |
| CN | 108463769 | A | | 8/2018 | |
| CN | 108474234 | A | | 8/2018 | |
| DE | 199 27 683 | C1 | | 1/2001 | |
| DE | 10 2005 002285 | A1 | | 7/2006 | |
| DE | 10 2008 026339 | A1 | | 12/2009 | |
| DE | 10 2009 006062 | A1 | | 7/2010 | |
| EP | 0 876 608 | B1 | | 4/2002 | |
| EP | 0 912 455 | B1 | | 5/2006 | |
| EP | 1 862 849 | A1 | | 12/2007 | |
| EP | 1 218 307 | B1 | | 7/2008 | |
| EP | 1 917 222 | B1 | | 3/2009 | |
| GB | 2077834 | A | * | 12/1981 | ..... E06B 3/6707 |
| JP | H07-279544 | A | | 10/1995 | |
| JP | 2017-534779 | A | | 11/2017 | |
| WO | WO 2007/101964 | A1 | | 9/2007 | |
| WO | WO 2010/112789 | A2 | | 10/2010 | |
| WO | WO 2010/147494 | A1 | | 12/2010 | |
| WO | WO 2011/033313 | A1 | | 3/2011 | |
| WO | WO 2012/007334 | A1 | | 1/2012 | |
| WO | WO 2013/104507 | A1 | | 7/2013 | |
| WO | WO 2014/095097 | A1 | | 6/2014 | |
| WO | WO 2016/046081 | A1 | | 3/2016 | |

OTHER PUBLICATIONS

International Search Report as issued in International Patent Application No. PCT/EP2019/078621, dated Nov. 11, 2019.
Notice of Reasons for Refusal as issued in Japanese Patent Application No. 2021-524974, dated Feb. 22, 2022.
First Office Action as issued in Chinese Patent Application No. 201980073370.9, dated May 23, 2022.

* cited by examiner

INSULATING GLAZING WITH DOUBLE SPACER

CROSS-REFERENCE TO RELATED APPLICATIONS

This application is the U.S. National Stage of PCT/EP2019/078621, filed Oct. 22, 2019, which in turn claims priority to European patent application number 18205063.3 filed Nov. 8, 2018. The content of these applications are incorporated herein by reference in their entireties.

The invention relates to an insulating glazing, a method for producing the insulating glazing, and use thereof.

Insulating glazings usually contain at least two panes of glass or polymeric materials. The panes are separated from one another by a gas- or vacuum-space defined by the spacer. The thermal insulation capacity of insulating glass is significantly higher than that of single glass and can be even further increased and improved in triple glazings or with special coatings.

In addition to the important property of thermal insulation, functional as well as optical and aesthetic features also increasingly play an important role in the field of building glazing. Functional coatings or functional elements are generally required for this. Such functional coatings or functional elements must usually be electrically contacted with a supply voltage, for which additional components, such as connection elements and bus bars must be provided. Often, the optical transparency and the overall visual impression of the insulating glazing are adversely affected by the additional components. For example, an insulating glazing with an electrochromic coating requires electrical connections and bus bars. One problem associated, for example, with the bus bars present in insulating glazings consists in that the bus bars are visible from the outside, which reduces the visible area of the window and, moreover, is aesthetically unsightly.

The prior art generally uses an opaque coating, usually applied by screen printing on a pane to conceal the bus bar. However, such a solution is associated with some disadvantages. First, an additional production step is necessary to apply the opaque coating, which increases production costs and processing time. Second, the aesthetic benefit is limited, since relatively large regions of the pane must be provided with the opaque coating in order to achieve suitable coverage of the bus bar, thus excessively restricting the visible region of the insulating glass. In addition, for production-engineering reasons, the opaque coating and the spacer used usually have different colors, which is also undesirable for aesthetic reasons. Moreover, the opaque coating can also adversely affect the thermal properties of the insulating glazing, since it usually has thermal characteristics different from the panes, for example, in terms of thermal expansion, which can result in mechanical stress or even in thermal breakage when temperatures change.

Another option for concealing a bus bar uses a specially modified spacer. US 2014/0247475 A1 discloses an insulating glazing with an electrochromic functional unit contacted via a bus bar. In this case, the spacer is configured such that it includes a structure behind which the bus bar can be hidden so it is no longer visible to the user of the window. The structure can be configured such that an indentation is created in which the bus bar is arranged so there is less compression of the bus bar. A disadvantage of this arrangement is that a precisely fitting spacer must be provided for each pane and each new configuration of the bus bar.

The object of the invention is to provide an improved insulating glazing that offers the capability of hiding an element to be concealed from the view of the user and is, at the same time, economical and simple to produce.

The object of the present invention is accomplished according to the invention by an insulating glazing as described hereinafter. Preferred embodiments are apparent from the dependent claims. A method for producing an insulating glazing according to the invention and the use thereof are apparent from further claims.

The insulating glazing according to the invention comprises at least a first pane, a second pane, a spacer frame arranged between the panes, which, together with the first pane and the second pane, delimits an inner interpane space. Arranged on the outwardly directed side of the inner spacer frame is an outer spacer frame, which, together with the two panes, delimits an outer interpane space open to the external environment. The inner spacer frame consists substantially of a first hollow profile spacer and the outer spacer frame consists substantially of a second hollow profile spacer. Here, "substantially" means that the frame consists of the respective hollow profile spacer, but that, for example, corner or longitudinal connectors can be used to connect individual hollow profile strips. Compared to spacers designed solid, hollow profile spacers have better insulating properties. In addition, a desiccant can, optionally, be arranged within the hollow space of a hollow profile. The inner spacer frame and the outer spacer frame are in each case connected to the first pane and the second pane via a primary sealant. This ensures that no moisture can make its way into the inner interpane space. The outer interpane space between the outer side of the outer spacer frame and the two panes is filled with a secondary sealant. The secondary sealant contributes to the stability of the insulating glazing and absorbs the mechanical loads stressing the edge seal.

The invention thus provides an insulating glazing with a double spacer frame. Thanks to the modular structure with a first hollow profile spacer and a separate second hollow profile spacer, the overall height can be flexibly adjusted by the edge seal made up of the spacer and sealants. Thus, components can be hidden from the view of the user of the insulating glazing by the inner spacer frame. The appearance of a hollow profile spacer can be flexibly adapted to the respective requirements, for example, by selection of a suitable material. A further advantage of the modular structure is the capability of arranging additional components within one of the two spacer frames or preferably between the two spacer frames, which components would otherwise have to be accommodated in the region of the secondary sealant or in the inner interpane space.

The hollow profile spacers preferably comprise in each case a first pane contact wall and a second pane contact wall to which the first and the second pane are secured. The two pane contact walls are connected to one another by an outer wall. The outer wall of the spacer is intended, in the insulating glazing, to face toward external environment. The glazing interior wall, which connects the two pane contact walls to one another, runs parallel to the outer wall. The glazing interior wall is intended, in the finished insulating glazing, to face toward the inner interpane space. The two pane contact walls, the glazing interior wall, and the outer wall enclose a hollow chamber, in which, for example, a desiccant can be filled. The pane contact walls and the outer wall are connected to one another directly or via connecting walls. The preferably two connecting walls preferably have an angle α (alpha) of 30° to 60° relative to the pane contact walls.

The primary sealant preferably contains a butyl, particularly preferably a polyisobutylene. The polyisobutylene can be a crosslinking or non-crosslinking polyisobutylene.

The primary sealant is preferably introduced with a thickness of 0.1 mm to 0.8 mm, particularly preferably 0.2 mm to 0.4 mm into the gap between the spacer frame and the panes.

The outer interpane space of the insulating glazing is preferably filled with a secondary sealant. The secondary sealant serves primarily for the bonding of the two panes and thus for the mechanical stability of the insulating glazing.

The secondary sealant preferably contains polysulfides, silicones, silicone rubber, polyurethanes, polyacrylates, copolymers and/or mixtures thereof. Such materials have very good adhesion to glass such that the secondary sealant ensures secure bonding of the panes. The thickness of the secondary sealant is preferably 2 mm to 30 mm, particularly preferably 5 mm to 10 mm, most particularly preferably 7 mm to 8 mm.

The panes contain materials such as glass and/or transparent polymers. The panes preferably contain glass and/or polymers, preferably flat glass, float glass, quartz glass, borosilicate glass, soda lime glass, polycarbonate, polymethyl methacrylate, and/or mixtures thereof. The first pane and/or the second pane can also be implemented as a composite pane. The panes preferably have optical transparency of >85%. In principle, various geometries of the panes are possible, for example, rectangular, trapezoidal, and rounded geometries. One or more panes can be provided with a functional coating, for example, with a low-E coating. Low-E coatings are thermal-radiation-reflecting coatings that reflect a considerable portion of infrared radiation, resulting in reduced heating of the living space in the summer. A wide variety of low-E coatings are, for example, known from DE 10 2009 006 062 A1, WO 2007/101964 A1, EP 0 912 455 B1, DE 199 27 683 C1, EP 1 218 307 B1, and EP 1 917 222 B1.

A gap of preferably 1 mm to 10 mm can be provided between the inner spacer frame and the outer spacer frame. However, the inner space frame is preferably placed directly on the outer spacer frame such that the through-vision region of the insulating glazing is as large as possible.

Between the inner spacer frame and the outer spacer frame, an adhesive, a sealant, or a filler can be arranged or no other material can be attached. Preferably, no adhesive, sealant, or filler is arranged between the two spacer frames.

In a preferred embodiment, the width b1 of the first hollow profile spacer is smaller than the width b2 of the second hollow profile spacer. By selecting a narrower first hollow profile spacer, the space available for an element to be concealed between the hollow profile spacer and the pane is increased. In contrast to spacers with fixed structures, here, as a result of the modular structure with an inner and an outer spacer frame, many different combinations can be realized very flexibly. Compared to a spacer frame with a constant width, the risk is reduced that an element to be concealed is squeezed or that stresses increasingly occur in the region of the point of contact of the spacer and the pane. This can ultimately result in leaks in the region of the primary sealant, resulting in leakage of the entire insulating glazing. Preferably, the width b1 is smaller by 0.1 mm to 2 mm than the width b2.

In an alternative preferred embodiment, the width b1 of the first hollow profile spacer is the same as the width b2 of the second hollow profile spacer. The advantage of two hollow profile spacers with the same width is that only a single type of of spacer is needed for an insulating glazing and also that the tools do not have to be adapted during automatic production.

The width of a hollow profile spacer is the shortest distance between the two pane contact walls measured along a glazing interior wall. The width of a hollow profile spacer defines the distance between two adjacent panes of the insulating glazing and is 6 mm to 38 mm, preferably 8 mm to 16 mm.

The height of a hollow profile spacer is the distance between the glazing interior wall and the outer wall measured along a pane contact wall. The height is not measured in the region of the connecting walls. The height of a single hollow profile spacer is preferably between 4 mm and 15 mm.

In another preferred embodiment, an element to be concealed is arranged on one of the two panes, which element is arranged between the first hollow profile spacer and the relevant pane such that the element to be concealed is concealed by the first hollow profile spacer. In the context of the invention, "concealed" means that the element to be concealed is hidden by the first hollow profile spacer from the observer looking through the insulating glass from the inside of the building or the outside of the building. In this case, the hollow profile spacer blocks the view of the element to be concealed when looking through the pane that is opposite the pane with the element to be concealed. The element to be concealed, such as a wire, can be embedded in the primary sealant between the first hollow profile spacer and the relevant pane. If a leak occurs in the region of the primary sealant due to the presence of the element to be concealed between the pane and the hollow profile spacer, there is an additional seal thanks to the outer spacer frame, since this is also connected to the outer panes by a primary sealant.

In a preferred embodiment, the element to be concealed is a bus bar or a cable that is connected to an electrically switchable functional element. In prior art insulating glazings, such elements must be concealed in a complex manner by masking prints on the outer side of at least one pane in order to block the view of the observer. This is not necessary when cables and/or bus bars are hidden by the first hollow profile spacer. Since the primary sealant is usually electrically insulating, even electrically conductive components can be arranged in this region.

Bus bars are, for example, strips of an electrically conductive material or electrically conductive imprints with which electrically conductive layers can be connected. The bus bars are used to transfer electrical power and enable homogeneous voltage distribution. The bus bars are advantageously produced by printing a conductive paste. The conductive paste preferably contains silver particles and glass frits. The layer thickness of the conductive paste is preferably from 5 μm to 20 μm.

In an alternative embodiment, thin and narrow metal foil strips or metal wires are used as bus bars, which preferably contain copper and/or aluminum; in particular, copper foil strips with a thickness of, for example, approx. 50 μm are used. The width of the copper foil strips is preferably 1 mm to 10 mm. The electrical contact between an electrically conductive layer serving as a flat electrode and the bus bar can, for example, be established by soldering or gluing with an electrically conductive adhesive.

In a preferred embodiment, an electrically switchable functional element is arranged on the side of a pane facing the inner interpane space. The arrangement on the side of the pane facing the inner interpane space ensures that the electrically switchable functional element is well protected against external influences, such as moisture and mechanical damage.

In a preferred embodiment, the electrically switchable functional element is formed by two electrically conductive layers and an active layer. The electrically conductive layers form flat electrodes. By applying a voltage to the flat electrodes, or by changing the voltage applied to the flat electrodes, the optical properties of the active layer, in particular the transmittance and/or the scattering of visible light, can be influenced.

The electrically conductive layers are preferably transparent. The electrically conductive layers preferably contain at least a metal, a metal alloy, or a transparent conducting oxide (TCO). The electrically conductive layers preferably contain at least one transparent conducting oxide.

The electrically conductive layers preferably have a thickness of 10 nm to 2 μm, particularly preferably of 20 nm to 1 μm, most particularly preferably of 30 nm to 500 nm, and insbesondere of 50 nm to 200 nm. Advantageous electrical contacting of the active layer is thus achieved.

The electrically conductive layers are intended to be electrically conductively connected to at least one external voltage source in order to serve as flat electrodes of the switchable functional element.

In an advantageous embodiment of the invention, the electrically switchable functional element is an electrochromic functional element. The active layer of the multilayer film is an electrochemically active layer. The transmittance of visible light is a function of the degree of incorporation of ions into the active layer, with the ions provided, for example, by an ion storage layer between the active layer and a flat electrode. The transmittance can be influenced by the voltage applied to the flat electrodes, which causes migration of the ions. Suitable active layers contain, for example, at least tungsten oxide or vanadium oxide. Electrochromic functional elements are known, for example, from WO 2012007334 A1, US 20120026573 A1, WO 2010147494 A1, and EP 1862849 A1.

In another advantageous embodiment of the invention, the electrically switchable functional element is attached to a PDLC functional element (polymer dispersed liquid crystal). The active layer contains liquid crystals, which are, for example, embedded in a polymer matrix. When no voltage is applied to the flat electrodes, the liquid crystals are aligned in a disordered manner, resulting in strong scattering of the light passing through the active layer. When a voltage is applied to the flat electrodes, the liquid crystals align themselves in a common direction and transmittance of light through the active layer is increased. Such a functional element is known, for example, from DE 102008026339 A1.

In another advantageous embodiment of the invention, the insulating glazing includes an electroluminescent functional element in the inner interpane space. The active layer contains electroluminescent materials that can be inorganic or organic (OLED). The luminescence of the active layer is excited by applying a voltage to the flat electrodes. Such functional elements are, for example, known from US 2004227462 A1 and WO 2010112789 A2.

In another advantageous embodiment of the invention, the electrically switchable functional element is an SPD functional element (suspended particle device). The active layer contains suspended particles that are preferably embedded in a viscous matrix. The absorption of light by the active layer can be changed by applying voltage to the flat electrodes, resulting in a change in the orientation of the suspended particles. Such functional elements are, for example, known from EP 0876608 B1 and WO 2011033313 A1.

The electrically switchable functional element can, of course, have other layers known per se in addition to the active layer and the electrically conductive layers, for example, barrier layers, blocking layers, antireflection layers or reflection layers, protective layers, and/or smoothing layers.

The electrically switchable functional element can alternatively also include an electrically heatable coating, a photovoltaic coating integrated in the insulating glazing, and/or a thin-film transistor-based liquid crystal display (TFT-based LCD).

In a preferred embodiment, at least the first hollow profile spacer is made substantially of a polymeric material. Polymeric spacers have lower thermal conductivity compared to metallic spacers. In addition, a polymeric spacer is preferred in particular in the case of combination with electrically conductive components in the region of the inner spacer thanks to its insulating properties. Particularly preferably, the second hollow profile spacer is also made of a polymeric material since this further improves the insulating properties of the edge seal. Preferably, both hollow profile spacers are made of the same material such that during heating and cooling of the edge seal, no stresses develop as a result of different material properties.

A polymeric hollow profile spacer preferably contains or consists of biocomposites, polyethylene (PE), polycarbonate (PC), polypropylene (PP), polystyrene, polybutadiene, polynitriles, polyesters, polyurethanes, polymethyl methacrylates, polyacrylates, polyamides, polyethylene terephthalate (PET), polyethylene terephthalate glycol (PETG), polybutylene terephthalate (PBT), acrylonitrile butadiene styrene (ABS), acrylonitrile styrene acrylester (ASA), acrylonitrile butadiene styrene/polycarbonate (ABS/PC), styrene acrylonitrile (SAN), PET/PC, PBT/PC, or copolymers thereof. A polymeric hollow profile spacer can additionally contain fillers or reinforcing elements. Reinforcement with glass fibers is preferred. Preferably, the main body of the hollow profile spacer has a glass fiber content of 20% to 50%, particularly preferably of 30% to 40%. The glass fiber content in the main body enables adjustment of the coefficient of thermal expansion and, at the same time, improves strength and stability.

In a preferred embodiment of the insulating glazing according to the invention, the first hollow profile spacer contains a desiccant in a first hollow chamber. The desiccant serves to absorb moisture out of the inner interpane space and thus prevents fogging of the insulating glazing from inside. The hollow chamber with the desiccant is connected to the inner interpane space such that a gas exchange is possible so the desiccant can absorb moisture out of the inner interpane space. Preferably, openings are made in the glazing interior wall of the first hollow profile spacer through which a connection is established between the first hollow chamber and the inner interpane space. Thus, the desiccant can absorb moisture out of the inner interpane space. The glazing interior wall is the wall of a hollow profile spacer that faces toward the inner interpane space. The openings can be made in the form of slots or holes as needed. Alternatively, the glazing interior wall can be implemented porous such that a gas exchange is possible between the inner interpane space and the first hollow chamber.

It is sufficient for only one of the two spacer frames to contain a desiccant. Preferably, this is the inner spacer frame, as this can more efficiently absorb moisture from the directly adjacent inner interpane space. Alternatively, a desiccant can also be arranged only in the outer spacer frame if, for example, this is easier to implement in production or is preferable for optical reasons. Preferably, the hollow chamber of one of the two spacer frames is empty. This improves the thermal insulating properties of the edge seal.

Alternatively, a desiccant is preferably arranged both in the first hollow profile spacer and in the second hollow profile spacer. Thus, the capacity for absorption of moisture can be further increased. This extends the service life of the insulating glazing. Preferably, when a desiccant is placed in both spacer frames, no sealant or adhesive is arranged between the inner and outer spacer frames such that gas exchange between the inner interpane space and the second hollow chamber of the second hollow profile spacer is possible.

Particularly suitable as desiccants are silica gels, molecular sieves, $CaCl_2$, $Na_2SO_4$, activated carbon, silicates, bentonites, zeolites, and/or mixtures thereof.

In another preferred embodiment, a gas- and moisture-tight barrier is attached at least on the outer wall of the second hollow profile spacer. Preferably, the gas- and moisture-tight barrier is additionally secured on at least part of the pane contact walls. The gas- and moisture-tight barrier is, in particular, useful in the case of polymeric hollow profile spacers. In a preferred embodiment, the gas- and moisture-tight is attached exclusively to the second hollow profile spacer. Attachment to the outer spacer frame is sufficient since a continuous seal of the insulating glazing is thus achieved. Although a second barrier does improve the sealing of the insulating glazing, it increases the material costs.

The gas- and moisture-tight barrier increases the gas- and moisture-diffusion tightness of the spacer and thus improves the sealing of the insulating glazing unit against the loss of any gas filling that may be present and against the penetration of moisture into the inner interpane space. Suitable barriers are known from the prior art. Considered in particular are metallic foils and polymeric films with metallic coatings, as disclosed, for example, in WO2013/104507 or WO2016/046081.

In a preferred embodiment, the gas- and vapor-tight barrier is implemented as a barrier film. The barrier film is preferably a multilayer film that contains at least one polymeric layer and at least one ceramic layer and/or one metallic layer.

Preferably, the barrier film contains at least one polymeric layer that is coated on both sides with a metallic or ceramic layer such that a metallic-polymeric-metallic, ceramic-polymeric-ceramic, or ceramic-polymeric-metallic layer sequence results. Such a polymeric layer coated on both sides is preferably bonded to any other layers.

Preferably, such a film coated on both sides is bonded to at least one other polymeric film coated on one side or both sides. In this way, a multilayer barrier film that contains multiple metallic and/or ceramic layers can be produced. The metallic and ceramic layers increase the gas diffusion density and moisture diffusion density. A combination of multiple metallic and/or ceramic layers can advantageously improve tightness since defects in one layer can be compensated by another layer.

The metallic layers preferably contain aluminum, silver, magnesium, indium, tin, copper, gold, chromium, nickel, and/or alloys or oxides thereof. The metallic layers are preferably applied in a vacuum thin-film process or, alternatively, via metal vapor deposition and have in each case a thickness of 10 nm to 800 nm, particularly preferably 20 nm to 50 nm.

The ceramic layers preferably contain silicon oxides ($SiO_x$) and/or silicon nitrides. The ceramic layers preferably have a thickness of 10 nm to 800 nm, particularly preferably 20 nm to 50 nm. Layers of this thickness improve gas diffusion density and moisture diffusion density.

The polymeric layers of the barrier film preferably include polyethylene terephthalate, ethylene vinyl alcohol, polyvinylidene chloride, polyamides, polyethylene, polypropylene, silicones, acrylonitriles, polyacrylates, polymethylacrylates, and/or copolymers or mixtures thereof.

A polymeric layer is preferably implemented as a single-layer film. This is advantageously economical. In an alternative preferred embodiment, the polymeric layer is implemented as a multilayer film. In this case, multiple layers of the above mentioned materials are bonded to one another. This is advantageous because material properties can be perfectly matched to the sealant, the adhesive, or the adjacent layers used.

The polymeric layers preferably have a layer thickness of 5 μm to 80 μm.

In an alternative preferred embodiment, the gas- and vapor-tight barrier is implemented as a barrier coating. This barrier coating contains aluminum, aluminum oxides, and/or silicon oxides and is preferably applied by a PVD method (physical vapor deposition). The barrier coating containing aluminum, aluminum oxides, and/or silicon oxides provides particularly good results in terms of tightness and additionally demonstrates excellent properties of adhesion to the secondary sealants used in the insulating glazing unit, when this is used as an outer layer.

In an alternative preferred embodiment, at least one of the hollow profile spacers is made of a metal. Preferred are aluminum, stainless steel, or steel. Metallic spacers are characterized by excellent gas- and moisture-tightness.

In another preferred embodiment of the insulating glazing according to the invention, at least the first hollow profile spacer is implemented such the first pane contact wall is connected to the outer wall via a first connecting wall and the second pane contact wall is connected to the outer wall via a second connecting wall, with the two connecting walls having in each case an angle of 30° to 60° relative to the pane contact walls. A first and a second intermediate space are created between the connecting walls of the first hollow profile spacer, the outer panes, and the glazing interior wall of the second hollow profile spacer. This intermediate space can be completely filled, preferably with the primary sealant, or it provides space, for example, for the contacting of an electrically switchable functional element.

In an alternative preferred embodiment, only one of the two pane contact walls of the first hollow profile spacer is connected to the outer wall via a connecting wall such that only a first intermediate space is created.

Preferably, a cable or a wire is arranged within at least one intermediate space, which leads as an electrical supply line, for example, from a first side of the insulating glazing to a second side of the insulating glazing. This is useful, for example, if an electrical connection cable is routed into the inner interpane space at a first location and then is to be routed within the interpane space along the spacer frame to a second location as invisibly as possible for the observer of the insulating glazing. According to known solutions, this is usually done in the outer interpane space, which means additional effort for production of the insulating glazing since the filling with the secondary sealant can no longer be automated.

In another preferred embodiment, the insulating glazing includes a pressure equalization body. A pressure equalization body enables pressure equalization in the finished insulating glazing, which is, in particular, advantageous in the event of strong fluctuations in air pressure. This can occur, for example, after transport from the production site of the insulating glazing to the place of use. Pressure equalization can also be advantageous in the event of strong temperature fluctuations since inward or outward bulging of the panes is thus prevented. There are various pressure equalization bodies in the prior art from which the person skilled in the art can make a suitable selection. Capillary tubes, valves with membranes, or hollow bodies with membranes, mounted in each case in the spacer frame, as described, for example, in CH687937A5, DE102005002285A1, WO2014/095097A1, are possible.

Preferably, a pressure equalization body is arranged only in the outer spacer frame, in which case no barrier is arranged on the inner spacer frame and the first hollow profile spacer is a polymeric spacer. Thus, gas exchange and, consequently, pressure equalization through the inner spacer frame is possible.

In another preferred embodiment, the insulating glazing includes a central spacer frame, which consists substantially of a third hollow profile spacer. Thus, the overall height of the edge seal can be designed more flexibly; and, at the same time, the possibilities for accommodating additional components are expanded. Even an insulating glazing with further additional spacer frames is possible.

The above-described embodiments can be applied analogously to multiple insulating glazings having three, four, or more panes. In that case, the embodiment according to the invention with a double spacer frame can be arranged in one, in several, or in all interpane spaces. An electrically switchable functional element can be arranged on one of the outer panes or on one of the inner panes.

Another aspect of the present invention is a method for producing an insulating glazing according to the invention. Provided first is the first pane, to which the outer spacer frame comprising the second hollow profile spacer is secured. For example, the primary sealant is applied in the corresponding region and the second hollow profile spacer is then placed there and thus secured. In the region surrounded by the outer spacer frame, the inner spacer frame is then secured in the same manner using a primary sealant. Thus, a double spacer frame is produced on the first pane. In another step, the second pane is placed on this double spacer frame and secured via a primary sealant. This pane arrangement is preferably pressed in another step to create a sealed connection between the spacer frame and the outer panes. The outer spacer frame is arranged such that it delimits, along with the two panes, an outer interpane space open to the external environment. In a further step, this outer interpane space is at least partially filled with a secondary sealant. Preferably, the secondary sealant is extruded directly into the outer interpane space.

Optionally, the inner interpane space is filled with an inert gas, such as argon or krypton, prior to the pressing of the pane arrangement.

In a preferred embodiment of the method according to the invention, the inner spacer is installed such that it conceals an element to be concealed, which is arranged on the first pane and/or on the second pane. Here, for example, one of the panes is provided with an electrically switchable functional element that is electrically conductively contacted via a bus bar. This bus bar is situated in the edge region of the insulating glazing such that the inner spacer frame can be directly attached to it via a primary sealant.

The bus bar is, in turn, preferably electrically conductively connected to an external voltage source via an electrical connection cable. These connections are carried out prior to the pressing of the pane arrangement. If a further connection cable is required, or if a connection cable has to be routed to a more distant location in the insulating glazing, this connection cable can easily be routed along between the two spacer frames. Preferably, the connection cable can be routed in an intermediate space between the two hollow profile spacers and a pane if the first hollow profile spacer includes angled connecting walls. This intermediate space is freely accessible prior to the placement of the second pane. Thus, after the pressing of the pane arrangement, an electrical connection cable is routed into the outer interpane space at only one location of the spacer frame. Consequently, the subsequent filling with a secondary sealant can be automated since no interfering connection cables are present for long stretches.

The above-described steps of the method according to the invention do not all have to be carried out in the order described. For example, the inner spacer frame can be secured first and then the outer spacer frame. Moreover, additional steps are also possible.

The present invention further includes the use of an insulating glazing according to the invention as building interior glazing or building exterior glazing.

Figure 2:
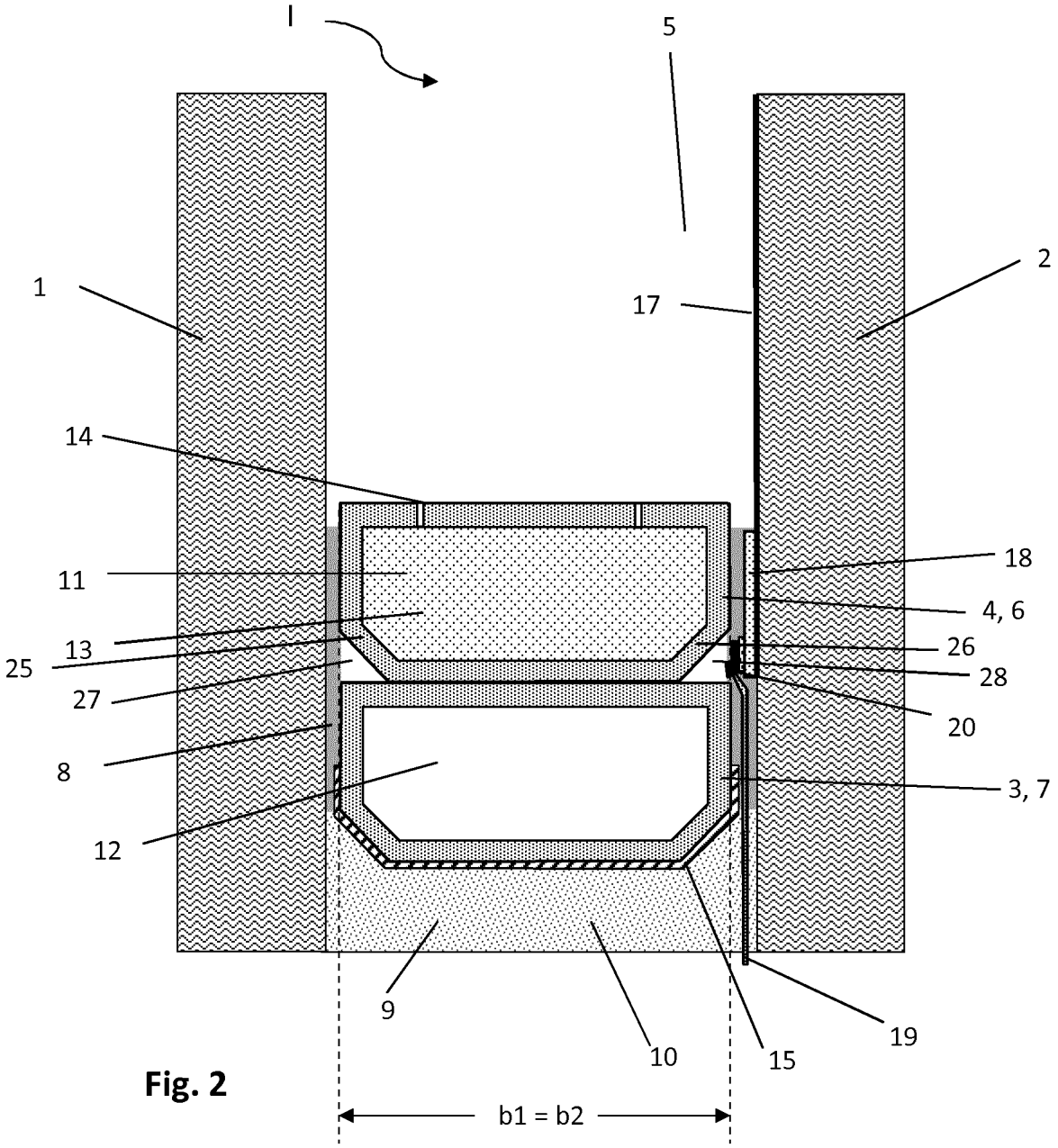
Figure 3:
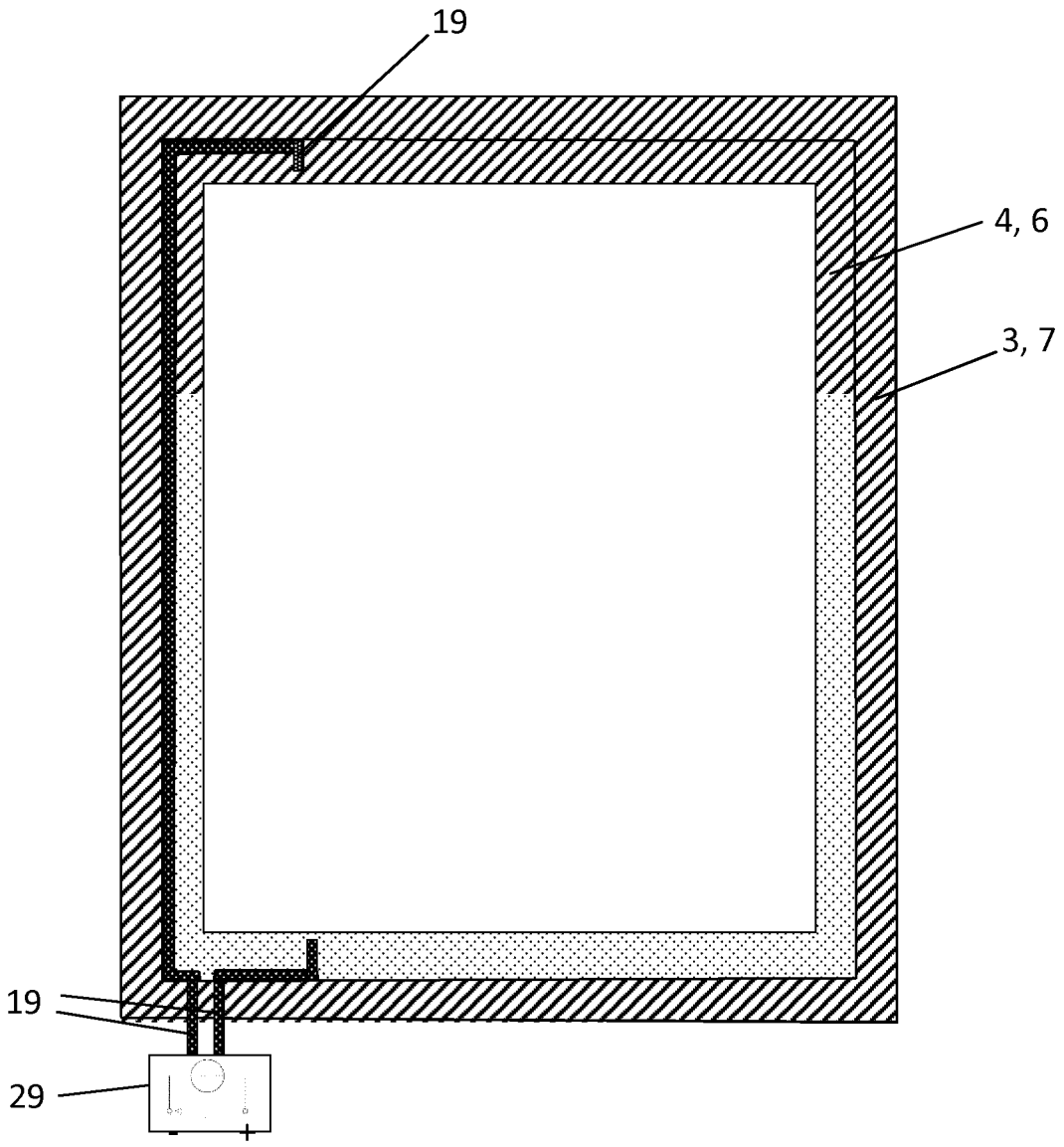

In the following, the invention is explained in detail with reference to drawings. The drawings are a purely schematic representation and not to scale. They in no way restrict the invention. The drawings depict:

FIG. 1 a cross-section through the edge region of an insulating glazing with a single spacer frame, FIG. 2 a cross-section through the edge region of an insulating glazing according to the invention with a double spacer frame, and FIG. 3 a schematic representation of a possible cable routing in the space between two spacer frames.

FIG. 1 depicts a representation of an insulating glazing in cross-section. The insulating glazing comprises a first pane 1 and a second pane 2 that are joined via a hollow profile spacer 7. The hollow profile spacer 7 is attached between the first pane 1 and the second pane 2 arranged parallel thereto. The hollow profile spacer 7 has a main body, which has a first pane contact wall 21, a second pane contact wall 22, which runs parallel to the first pane contact wall, an outer wall 24, and a glazing interior wall 23. The outer wall 24 is connected to the two pane contact walls 21, 22 via a connecting wall 25 or 26, respectively. The first connecting wall 25 has an angle $\alpha$ (alpha) of approx. 45° relative to the first pane contact wall. Analogously, the second connecting wall 26 is arranged at an angle of 45° relative to the second pane contact wall 22. The hollow profile spacer has a hollow chamber, which contains a molecular sieve as a desiccant 13. Openings 14 in the form of slots made after the fact, via which a connection is established between the hollow chamber and an inner interpane space 5, are made in the glazing interior wall 23. The inner interpane space 5 is defined by the first pane 1, the second pane 2, and the glazing interior wall 23 of the hollow profile spacer. The first pane 1 is connected to the first pane contact wall 21 via a primary sealant 8, and the second pane 2 is connected to the second pane contact wall 22 via a primary sealant 8. An outer interpane space 10 is delimited by the first pane 1, the second pane 2, and the outer wall 24 of the hollow profile spacer and is completely filled with a secondary sealant 9. A gas- and vapor-tight barrier film 15 in the form of a multilayer film with two 25-nm-thick aluminum layers and two 12-μm-thick polyethylene terephthalate layers, arranged alternatingly, is attached to the outer wall 24, the first connecting wall 25, the second connecting wall 26, and part of the first and second pane contact wall 21,22. This barrier film 15 improves the tightness against penetration of moisture.

The second pane 2 has an electrically conductive and/or electrically switchable coating 17 (electrical functional element) on the surface facing the inner interpane space 5. The coating 17 extends almost completely over the inside surface of the pane 2, minus an edge decoating of the edge of the pane. The coating 17 is contacted by a bus bar 18. The insulating glazing has an electrical connection cable 19 that can be connected to a voltage source (not shown). The electrical connection cable 19 and the bus bar 18 are electrically conductively connected to one another via an electrical contact element 20. The electrical contact between the electrically conductive and/or electrically switchable coating 17 and the bus bar 18 and between the bus bar 18 and the contact element 20 can be established by soldering or gluing with an electrically conductive adhesive. The contact element 20 can be a flexible cable. The cable can be T-shaped and have two metallic contacting surfaces on its two side arms, which are provided for contacting with the bus bar 18.

The bus bar 18 was produced by printing a conductive paste and electrically contacted on the electrical functional element 17. The conductive paste, also referred to as silver paste, contains silver particles and glass frits. The layer thickness of the baked conductive paste is, for example, approx. 5 μm to 20 μm. Alternatively, thin and narrow metal foil strips or metal wires that contain or are formed from copper, a copper alloy, or aluminum can also be used as a bus bar 18. The bus bar 18 extends on the second pane 2 in the inner interpane space 5 and parallel to the glazing interior wall 23 of the hollow profile spacer.

The first pane 1 is provided on the outside with an opaque coating 16 which is a black masking print. The coating is implemented in the form of a strip and begins at the glass edge and then extends beyond the upper end of the bus bars 18, such that the bus bar 18 is well concealed when looking through the first pane 1 from as many viewing angles as possible. In the example, the first pane is the pane that faces toward the building interior. The masking print 16 thus prevents the view of the bus bar when looking through the pane from the inside of the building. The masking print 16 restricts the through-vision region of the insulating glazing. Applying a second masking print on the second pane is optionally possible. Such a second masking print would conceal the bus bar when looking from the outside of the building.

FIG. 2 depicts an edge region of an insulating glazing I according to the invention, in cross-section. The insulating glazing corresponds substantially to the insulating glazing depicted in FIG. 1, except that the single spacer frame made of a hollow profile spacer 7 depicted in FIG. 1 is replaced by a double spacer frame of a first hollow profile spacer 6 and a second hollow profile spacer 7 and the masking print 16 depicted in FIG. 1 is not present. Apart from these differences, the information for FIG. 1 also applies to FIG. 2.

The insulating glazing I has an inner spacer frame 4 consisting of a first hollow profile spacer 6. The main body of the first hollow profile spacer 6 is made of styrene acrylonitrile with 20% glass fiber content and is opaque. The inner spacer frame 4 is composed of four individual sections of the first hollow profile spacer 6, which are joined to one another by welding at the corners of the insulating glazing. The first hollow profile spacer 6 has a first hollow chamber 11, into which a molecular sieve 13 is filled. The molecular sieve 13 absorbs the moisture out of the inner interpane space 5 via the openings 14 in the glazing interior wall of the first hollow profile spacer 6.

Arranged adjacent the outer wall 24 of the first hollow profile spacer is a second hollow profile spacer 7, which forms the outer spacer frame 3. The outer spacer frame 3 is composed of individual sections of the second hollow profile spacer 7 and welded at the corners. Both hollow profile spacers 6 and 7 are made of the same material. Thus, stresses due to different coefficients of expansion of different materials are avoided. No sealant or adhesive is arranged between the two spacer frames 3 and 4. They are arranged against one another without deliberately planned gaps. For production-related reasons, there can be a small distance of as much as half a millimeter between between the two spacer frames.

The second hollow profile spacer has a gas- and vapor-tight barrier 15 in the form of a multilayer film, as already described for FIG. 1, on its outer wall, the two connecting walls, and a part of the side walls. The gas- and vapor-tight barrier 15 overlaps the primary sealant 8, which is arranged between the panes 1, 2 and the two pane contact walls 21 and 22. In this manner, good sealing of the inner interpane space is achieved. The second hollow profile spacer 7 has no openings in its glazing interior wall. These are not necessary since no desiccant is contained in the second hollow chamber 12. The second hollow chamber 12 is empty. This improves the thermal insulating property of the hollow profile spacer compared to a filled hollow chamber 12.

The first and the second hollow profile spacer 6, 7 are both 6.5 mm high. The height of the bus bars 18 is approx. 4 mm. Thus, the bus bar is completely covered by the first hollow profile spacer 6. The bus bar 18 is mounted between the second pane contact wall of the first hollow profile spacer 6 and the second pane 2 on the electrically switchable functional element 17 as an element to be concealed. Thus, the inner spacer frame 4 obstructs the view of the bus bar 18, when looking through the first pane. Consequently, no masking print is arranged on the first pane 1. This reduces the number of production steps, improves the visual appearance of the insulating glazing, and avoids thermal stresses due to different heating of the printed and non-printed regions. If concealment of the element to be concealed is desired when looking through the second pane is desired, a masking print would have to be arranged there.

The first hollow profile spacer 6 has a first connecting wall 25, which forms, together with the the first pane 1 and the glazing interior wall of the second hollow profile spacer 7, a first intermediate space 27. In the example, the first intermediate space 27 is empty and thus provides space to accommodate a cable or wire or the like. Alternatively, the first intermediate space 27 can, for example, also be filled with the primary sealant. This intermediate space 27 forms a circumferential space between the inner and the outer spacer frame. The first hollow profile spacer 6 has a second connecting wall 26, which delimits, together with the second pane 2 and the glazing interior wall of the second hollow profile spacer 7, a second intermediate space 28. In this second intermediate space, there is, for example, space for the electrical contact element 20. Since the connection point between the electrical connection cable 19 and the bus bar 18 is not arranged between the second pane contact wall and the second pane, the connection between the inner spacer frame 4 and the second pane 2 is particularly good. This contributes to a longer service life of the insulating glazing.

The width b1 of the first hollow profile spacer 6 is 12 mm and is the same as the width b2 of the second hollow profile spacer b2. This is particularly advantageous since substantially the same hollow profile spacer can be used for the inner and the outer spacer frame, since they differ only in the gas- and vapor-tight barrier and the openings in the glazing interior wall.

Alternatively, b1 could be <b2 leaving space for the bus bar 18 and an electrical contact element between the second pane 2 and the second pane contact wall of the first hollow profile spacer 6. This is particularly advantageous if there are no angled connecting walls and thus no intermediate spaces 27, 28, as would be the case, for example, with a rectangular cross-section of the first hollow profile spacer 6.

FIG. 3 depicts an example of cable routing in an intermediate space between an inner spacer frame 4 and an outer spacer frame 3. The arrangement of the two spacer frames is as depicted in FIG. 2, as a result of which two intermediate spaces 27, 28 are created. An electrical connection cable 19 is now routed along in one of these intermediate spaces. At an entry point, the electrical connection cable leads, starting from the external voltage source 29 along a pane contact wall of the second hollow profile spacer 7 into an intermediate space 27 or 28 and leads from there to a contact point. FIG. 3 depicts two electrical connection cables 19, which lead to two contact points in the region of the inner spacer frame 3, where, for example, a bus bar can be situated in each case, which can be contacted via these connection cables 19. The routing along one complete side of the spacer frame is visually advantageously hidden from the view of the observer by the arrangement between the inner and the outer spacer frame. At the same time, routing in the outer interpane space in the finished insulating glazing is avoided, which is advantageous for production.

LIST OF REFERENCE CHARACTERS

I insulating glazing
1 first pane
2 second pane
3 outer spacer frame
4 inner spacer frame
5 inner interpane space
6 first hollow profile spacer
7 second hollow profile spacer
8 primary sealant
9 secondary sealant
10 outer interpane space
11 first hollow chamber
12 second hollow chamber
13 desiccant
14 opening
15 gas- and vapor-tight barrier
16 masking print, opaque coating
17 electrically switchable functional element, electrically switchable coating
18 bus bar
19 electrical connection cable
20 electrical contact element
21 first pane contact wall
22 second pane contact wall
23 glazing interior wall
24 outer wall
25 first connecting wall
26 second connecting wall
27 first intermediate space
28 second intermediate space
29 external voltage source
b1 width of the first hollow profile spacer
b2 width of the second hollow profile spacer

The invention claimed is:

1. An insulating glazing comprising:

a first pane, a second pane, an inner spacer frame arranged between the first and second panes, which, together with the first and second panes, delimits an inner interpane space, a surrounding outer spacer frame arranged between the first and second panes, which is arranged on the outward facing side of the inner spacer frame, wherein the inner spacer frame consists substantially of a first hollow profile spacer and the outer spacer frame consists substantially of a second hollow profile spacer, wherein the inner spacer frame and the outer spacer frame are each connected to the first pane and the second pane via a primary sealant, wherein an outer interpane space between an outer side of the outer spacer frame, the first pane, and the second pane is filled with a secondary sealant, wherein an electrically switchable functional element is arranged on a side of one of the first and second panes facing the inner interpane space, wherein an element to be concealed is arranged on one of the first and second panes, which element is arranged between the first hollow profile spacer and the one of the first and second panes such that the element to be concealed is concealed by the first hollow profile spacer, wherein the element to be concealed is a bus bar or a cable that is connected to the electrically switchable functional element, wherein the first hollow profile spacer and the second hollow profile spacer each comprise a first pane contact wall, a second pane contact wall, a glazing interior wall that connects the first and second pane contact walls to one another, and an outer wall that runs substantially parallel to the glazing interior wall and connects the first and second pane contact walls to one another, wherein the first pane contact wall, the second pane contact wall, the glazing interior wall and the outer wall of the first hollow profile spacer are different from the first pane contact wall, the second pane contact wall, the glazing interior wall and the outer wall of the second hollow profile spacer, wherein at least the first hollow profile spacer is implemented such that the first pane contact wall is connected to the outer wall via a first connecting wall and the second pane contact wall is connected to the outer wall via a second connecting wall, wherein the first and second connecting walls have an angle of 30° to 60° relative to, respectively, the first and second pane contact walls, as a result of which two intermediate spaces are created, which are in each case delimited by one of the first and second panes, the first hollow profile spacer, and the second hollow profile spacer, and wherein in at least one of the two intermediate spaces, a cable or wire is routed over a distance of at least 5 cm in a direction of extension of the spacer frame.

2. The insulating glazing according to claim 1, wherein a width b1 of the first hollow profile spacer is smaller than a width b2 of the second hollow profile spacer.

3. The insulating glazing according to claim 2, wherein the width b 1 of the first hollow profile spacer is 0.1 mm to 1 mm smaller than the width b2 of the second hollow profile spacer.

4. The insulating glazing according to claim 1, wherein at least the first hollow profile spacer is substantially made of a polymeric material.

5. The insulating glazing according to claim 4, wherein the second hollow profile spacer is made substantially of a polymeric material.

6. The insulating glazing according to claim 1, wherein the first hollow profile spacer contains a desiccant in a first hollow chamber and the first hollow profile spacer contains a plurality of openings in its glazing interior wall.

7. The insulating glazing according to claim 1, wherein the second hollow profile spacer has a gas- and moisture-tight barrier at least on its outer wall.

8. A method for producing an insulating glazing according to claim 1 comprising:

providing a first pane, securing an outer spacer frame made of a second hollow profile spacer on the first pane via a primary sealant, securing an inner spacer frame made of a first hollow profile spacer on the first pane via the primary sealant, wherein the outer spacer frame surrounds the inner spacer frame, securing a second pane on the arrangement composed of the first pane and the inner and outer spacer frames via a primary sealant, filling the outer interpane space between the first pane, the second pane, and the side of the outer spacer frame facing the external environment with a secondary sealant.

9. The method for producing an insulating glazing according to claim 8, wherein the inner spacer frame is attached such that the inner spacer frame covers an element to be concealed that is arranged on the first pane and/or on the second pane.

10. A method comprising utilizing an insulating glazing according to claim 1 as a building glazing.

* * * * *